US005269284A

United States Patent [19]

Pujos et al.

[11] Patent Number: 5,269,284

[45] Date of Patent: Dec. 14, 1993

[54] BOW GRIP

[75] Inventors: Pierre Pujos, Lissieu; Didier Sarrelongue, Lyons; Roland Brand, Meyzieu, all of France

[73] Assignee: Beman, Villeurbanne, France

[21] Appl. No.: 831,044

[22] Filed: Feb. 4, 1992

[30] Foreign Application Priority Data

Feb. 27, 1991 [FR] France ..... 91 02574

[51] Int. Cl.[5] ..... F41B 5/00

[52] U.S. Cl. ..... 124/88; 124/23.1

[58] Field of Search ..... 124/23.1, 88; 428/414, 428/415

[56] References Cited

U.S. PATENT DOCUMENTS

| | | | |
|---|---|---|---|
| 3,616,185 | 10/1971 | Goldberg | 428/415 X |
| 3,657,040 | 4/1972 | Shobert | 124/23.1 X |
| 3,766,904 | 10/1973 | Izuta | 124/88 X |
| 3,850,156 | 11/1974 | Eicholtz | 124/23.1 |
| 3,965,883 | 6/1976 | Meyer | 124/23.1 |
| 4,018,205 | 4/1977 | Meyer | 124/23.1 |
| 4,085,247 | 4/1978 | Godfried | 428/415 X |
| 4,323,623 | 4/1982 | Ahrens et al. | 428/246 |
| 4,443,566 | 4/1985 | Ying | 428/414 X |
| 4,599,268 | 7/1986 | Chellis | 428/415 X |
| 4,693,230 | 9/1987 | Sugouchi | 124/88 |
| 4,733,647 | 3/1988 | Mattheck | 124/88 X |
| 4,822,694 | 4/1989 | Randin et al. | 428/615 |
| 5,043,251 | 8/1991 | Sonnenschein et al. | 430/297 |

FOREIGN PATENT DOCUMENTS

| | | | |
|---|---|---|---|
| 2539224 | 7/1984 | France . | |
| 56298 | 5/1979 | Japan | 124/23.1 |
| 1312253 | 4/1973 | United Kingdom . | |

OTHER PUBLICATIONS

JP 2,306,099, Tsuchiyama Nobuo et al., Western Archery Handle, Mar. 4, 1991, Abstract.

*Primary Examiner*—Randolph A. Reese
*Assistant Examiner*—John Ricci
*Attorney, Agent, or Firm*—Oliff & Berridge

[57] ABSTRACT

This grip has a core (9) made from composite material constituted by a thermoplastic or thermosetting resin reinforced with long fibers, and an overmolding (10) which, covering the core over at least a portion of its surface, is produced from a resin whose curing temperature is less than the glass transition temperature of the resin constituting the core.

11 Claims, 2 Drawing Sheets

BOW GRIP

BACKGROUND OF THE INVENTION

The subject of the present invention is a bow grip. A bow is conventionally constituted by:

a grip, a pair of branches, and a bow-string.

The grip is the central portion of the bow, to which are fixed the two branches, which provides a housing for the hand in order to grip the bow, which supports accessories such as stabilizer, sight, arrow-support, this grip having a shoulder in its central portion, called bow-window, which enables the arrow to be propelled in the branch/bow-string plane without touching the bow.

DESCRIPTION OF THE PRIOR ART

There exist two types of bow, bows in which the bow-string is directly fixed to the extremities of the branches and COMPOUND-type bows, that is to say in which the branches are provided at their extremities with guide rollers for the passage of the bow-string. The bow-string then passes, in such a case, there and back several times, which permits a reduction in the force when pulling on the bow-string in order to bend the bow.

The general shape of the grip enables the bow to be given certain very special characteristics. It is thus possible to give the grip a substantially straight shape, the point for attaching the branches being substantially aligned with the central portion of the grip, or to give the grip a more or less curved shape, the point for attaching the branches being offset in relation to the central portion of the grip. The shape of the grip gives the bow specific characteristics and performance.

From the above it emerges that the grip comprises a certain number of mechanical functions as well as comfort functions: gripping zone for the hand, esthetic shape, colour.

At present grips are generally produced from adhesively-bonded laminated wood, machined in order to obtain the desired shape, from a machined aluminium alloy or from a magnesium alloy obtained by casting. In all cases, the production requires several complex operations and large investment, and the weight of the grip is significant. Now, an archer in competition has to hold his bow at arm's length for relatively long periods of time, such that the weight of the bow constitutes a factor of fatigue and therefore of inaccuracy.

It has therefore seemed desirable to reduce the weight of the grip and, consequently, the weight of the bow.

According to one possibility, described in document U.S. Pat. No. 4,693,230, a bow grip is produced from a synthetic material, comprising a core made from a foam of synthetic material, provided with a metallic reinforcement and surrounded by a reinforcement covering, constituted by three layers of composite material comprising long fibers. For example, the inner layer is constituted by a glass-fiber ROVING, the intermediate layer is constituted by a glass- or carbon-fiber fabric and the outer layer is constituted by a carbon-fiber ROVING.

After production of the core, made from a foam of synthetic material, and encasement of the latter by the composite material, the assembly is placed in a mold intended to produce its curing. During this curing, a certain curling of the grip may occur. After removal from the mold, it is necessary to perform finishing operations by sanding down followed by a polishing and a painting operation.

SUMMARY OF THE INVENTION

The object of the invention is to provide a bow grip made from a synthetic material, which possesses excellent strength qualities, which is of reduced weight and which is obtained during a limited number of operations so as to reduce its cost price.

For this purpose, the bow grip to which it relates, comprises a core made from composite material constituted by a thermoplastic or thermosetting resin reinforced with fibers, and an overmolding which, covering the core over at least a portion of its surface, is produced from a resin whose curing or injection temperature does not exceed the glass transition temperature of the resin constituting the core.

The core, of constant cross-section or otherwise, therefore provides the mechanical functions while the overmolding constitutes a sheathing of the core, permitting, on the one hand, the production of a pleasant finish to the grip and, on the other hand, the integration of the inserts for the attachment of the various accessories.

This type of grip relates equally well to conventional bows and to COMPOUND-type bows.

The general shape of the grip is variable, depending on the performance which it is desired to give the bow to be produced, possessing a more or less curved shape, and it being possible for the cross-section of the core to be virtually constant over its entire length, or, on the contrary, having a variable cross-section, depending on the manufacturing process implemented and depending on the desired performance.

The length of the core of the grip is of the order of 460 to 680 mm, depending on the desired performance and utilization. The width of the core, from 20 to 75 mm, is dictated, on the one hand, by solidity considerations imposed by the choice of materials, but also by esthetic criteria and comfort criteria demanded by the user.

The use of composite material enables the weight to be reduced and preferential reinforcements at critical points to be provided, whilst using a highly automated manufacturing process which reduces the labor costs. Furthermore, with a single core shape, it is possible to use several overmolding molds thus permitting diversification of the products obtained. The cost of overmolding can be low if low-pressure injection materials are used which correspond well to the esthetic requirements, this technique furthermore permitting easy inclusion of the inserts, such as metal parts.

Given that the overmolding is not necessarily to be painted, the finishing operations are greatly reduced and hence the labor costs are low.

It is possible, starting from the same technique, to have bows of different performance by varying:

the curvature, to a greater or lesser extent, the type of materials and, especially, of the fibers for reinforcing the core, and the type, hardness and elasticity of the overmolding material.

Advantageously, the fibers constituting the core are unidirectionally oriented and their amount lies between 30 and 75% of the volume of the core.

According to another characteristic of the invention, the fibers are homogeneously distributed in the cross-section of the core and at least some of these are continuous and extend over the entire length of the grip.

Furthermore, and so as to provide an excellent solidity to the grip, the fibers have a modulus greater than 50 GPa and a strength greater than 1500 MPa.

If carbon fibers are used, these have a modulus greater than 130 GPa and a strength greater than 1500 MPa. If glass fibers are used, these have a modulus greater than 50 GPa and a strength greater than 2500 MPa.

For a same grip, all the fibers may be of the same type or be of several different types such as carbon, aramid, glass fiber, polyethylene.

According to an embodiment of this grip, the core contains:

an epoxy resin based on bisphenol A, a hardener based on anhydride, an accelerator of the heterocyclic type.

It is possible to combine with the core elements for localized reinforcement, such as a fabric or a mat, or fillers constituted by short fibers or hollow spheres.

For its part, the overmolding made from resin may contain fillers such as spheres or short fibers and serves for fixing the inserts for the mounting of the branches and of the accessories. The overmolding resin is advantageously constituted by polyurethane and, preferentially, a ureol.

The grip according to the invention may be produced by various processes.

A first manual process consists in stacking preimpregnated fibers in a mold, before placing in a press and performing a cycle of raising the pressure and the temperature, intended to perfect the curing of the thermosetting resin and to render the thermoplastic matrix homogeneous. The part is subsequently removed from the mold before the overmolding operation. Although manual, this technique enables a prepared arrangement of the reinforcement fibers to be obtained, with possible positioning of complementary reinforcement elements made from mat or from fabric.

A second process consists in implementing a filament-winding technique.

The fibers are arranged over creels and pass into an impregnation system which controls the amount of resin in relation to the fibers. This impregnation is only necessary if the fibers are not already impregnated with resin.

An assembly of two half-molds side by side is put into rotation. The fibers are wound over these two half-molds. Once the volume necessary is wound, the rotation is stopped. The mold is extracted from the rotation shaft. The two half-shells are then placed in a press. This technique requires markedly less labor than for the previous technique. The arrangement of the fibers is unidirectional. If necessary, a mat or a fabric may be interposed locally by means of a manual operation.

A third process is known under the name of "pull/-press forming". This is an on-line impregnation method. However, the device for pulling the fibers is not rotatable, as in the previous case, but is linear. The pulling system integrates the molding as the fibers are held in heated lower and upper shells. The holding time as well as the pressures and temperatures define the quality of the curing. In this case the obtained cross-section is virtually constant. Insofar as the overmolding is only carried out on a portion of the core, the portion of the latter not overmolded may undergo finishing operations constituted, for example, by a sand-blasting, a varnishing, a marking and the operations for implantation of threaded studs by drilling and then adhesive bonding. It is also possible to avoid the drilling operations for the studs by providing places reserved in the core of the grip. The zones for supporting the branches are possibly milled out so as to ensure a perfect positioning of the latter, one in relation to the other and in relation to the plane of the grip.

In the case of a complete or virtually complete overmolding, it is advantageous to carry out the following operations with a view to good adherence of the overmolding:

sand-blasting, shot-peening, drilling holes for fastening the overmolding through the grip, milling out notches.

The metal elements are then implanted, by drilling and adhesive bonding with a polyurethane-type adhesive, before overmolding.

The overmolding matches the profile of the core, using a cross-section which is substantially rectangular at its center, so as to facilitate the gripping by the user and to promote mechanical strength, the large dimension in the direction of the cross-section being located in the plane of the branches and of the bow-string.

During the overmolding, the bow-window is preserved of course.

The dimensions of the overmolding are substantially identical to the dimensions of the core, it being possible for the overmolding thicknesses to range up to 30 mm. The overmolding permits accurate shaping of the housing for the hand according to the usual shapes or, on the contrary, provision of a location of defined shape for receiving an attached grip.

Depending on the material used for the overmolding, it is possible to stain the latter, throughout its bulk, avoiding all subsequent finishing operations or to proceed to a painting and marking operation, for example by pressure-pad printing or screen printing. It should be noted that the marking may very well be produced in relief, by etching the inside of the mold.

The overmolding materials are either thermo-setting synthetic materials or thermoplastic synthetic materials.

The overmolding is effected within a mold in which the core is prepositioned, the mold comprising housings for threaded inserts, advantageously placed in order to hold the core in position in the mold during the overmolding operation.

BRIEF DESCRIPTION OF THE DRAWINGS

In any case, the invention will be better understood with the aid of the description which follows with reference to the attached diagrammatic drawings representing, by way of non-limiting examples, several embodiments of this bow grip.

DESCRIPTION OF THE PREFERRED EMBODIMENTS

Figure 1:
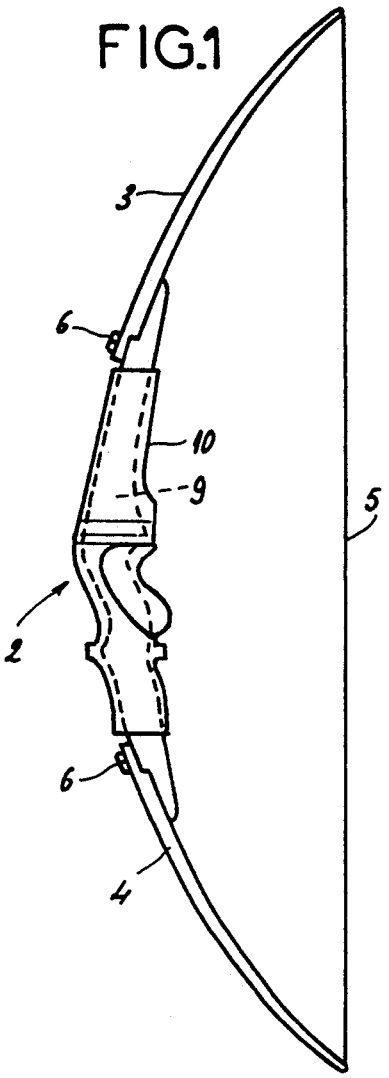
FIG. 1 is a side view of a bow equipped with a grip according to the invention.

FIG. 1 shows a bow comprising a grip 2 at the extremities of which are fixed respectively an upper branch 3 and a lower branch 4 whose free extremities are equipped with a bow-string 5. The two branches 3 and 4 are detachably mounted onto the grip 2 by screwing at 6. It is possible to produce various types of mounting, according to known methods, for possibly allowing a certain play in the branches or, on the contrary, for being able to mount them with the possibility of adjusting their inclination in order to modify the performance of the bow.

Figure 2:
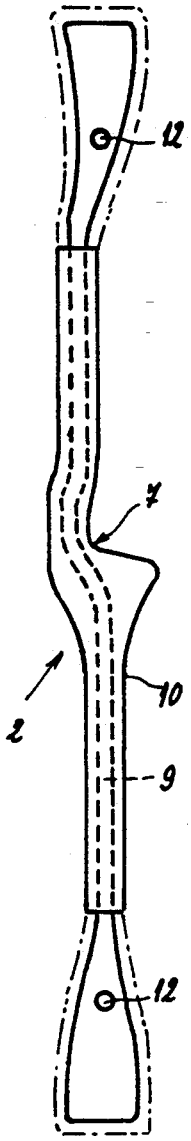
FIG. 2 is a front view, on a larger scale, of the bow grip of FIG. 1.

FIG. 2, which is a front view on a larger scale of the grip 2, shows that the latter has, in its central portion, a lateral shoulder providing a window 7 for the passage of the arrow. Below the window 7, the grip is shaped in order to have a gripping zone 8. In accordance with the essential characteristic of the invention, the grip 2 comprises a core 9 made from composite material and reinforced with fibers, over which is overmolded a portion 10 produced from a resin whose curing or injection temperature does not exceed the glass transition temperature of the resin constituting the core 9.

In the embodiment shown in FIG. 2, the over-molding extends only into the central portion of the grip, leaving visible at the extremities of the latter the two extremities of the core to which the branches 3 and 4 are directly fixed, after insertion of screwing inserts designated by the reference 12.

Figure 3:
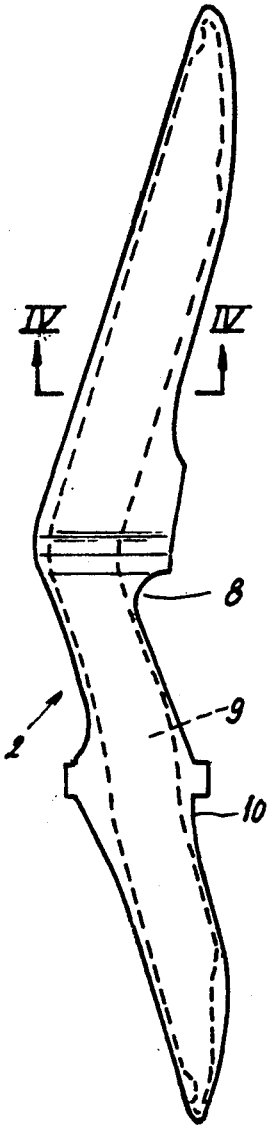
FIG. 3 is a side view of a variant of this bow grip.

FIG. 3 shows an alternative embodiment of this grip, in which the overmolding extends as far as the extremities, this overmolding having, in front view, the shape shown by the dot-dash lines of FIG. 2 in the end zones of the grip.

Figure 4:
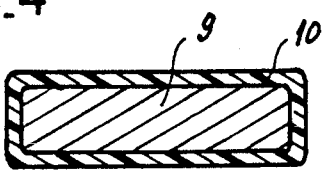
FIG. 4 is a sectional view along the line IV—IV of the grip of FIG. 3.

As shown in FIG. 4, the grip possesses a cross-section of rectangular general shape, this cross-section being able, for example, to have a curling at the level of the extremities, such that the large faces of the grip act as supports for the branches.

Figure 5:
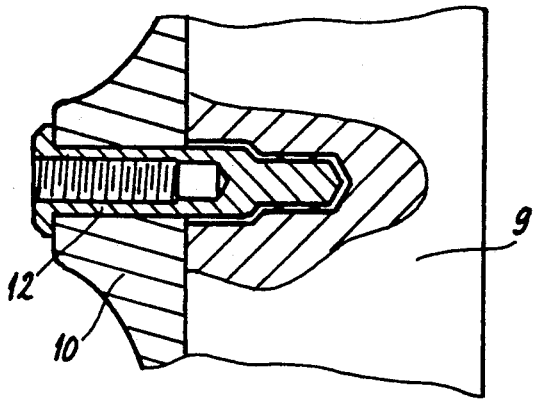
FIG. 5 is a sectional view, on a larger scale, of an insert combined with the core and with the over-molding.

FIG. 5 shows a screwed insert 12 which is mounted, on the one hand, in the core 9 and, on the other hand, in the overmolding 10 which it traverses. The insert 12 is firstly mounted in a hole provided for this purpose in the core 9 where it is fixed by adhesive bonding, this insert 12 then serving for the positioning of the core 9 inside the mold in which the overmolding 10 is produced.

Figure 6:
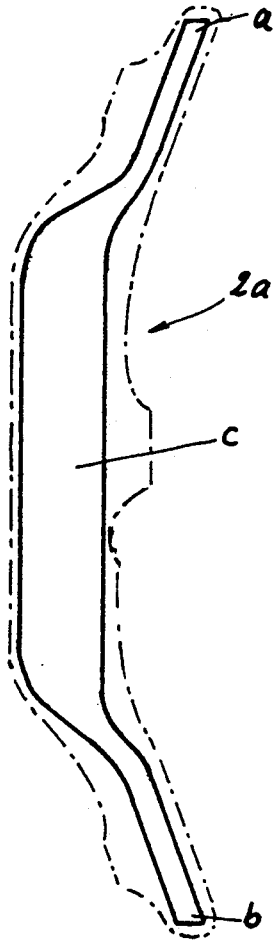
FIGS. 6 and 7 are two very diagrammatic side views of two bow grips having other shapes.
Figure 7:
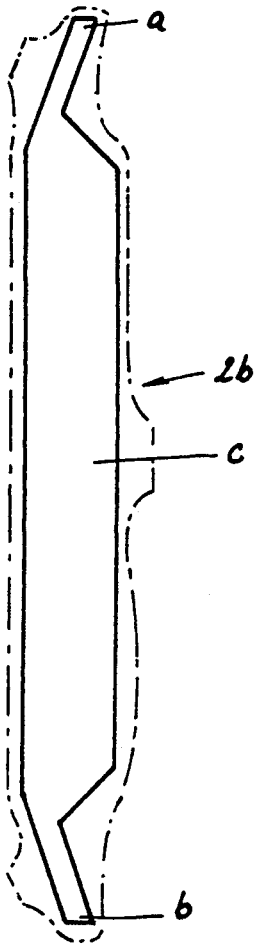

FIGS. 6 and 7 show two alternative embodiments of this grip, designated respectively by the references 2*a* and 2*b*. The grip 2*a* possesses a relatively curved shape, the points A and B of its extremities being located substantially set back from its central portion C. By contrast, in the grip shown in FIG. 7, the points A and B are substantially in line with the point C.

The two grips 2*a* and 2*b* comprise a core which is totally shrouded by an overmolding. However, in both cases, the core could comprise only a partial over-molding.

As emerges from the above, the invention greatly improves the existing technique by providing a bow grip produced from synthetic material and consequently very light, whilst possessing excellent performance, which is imparted to it by the solidity of its core, and and excellent finish obtained by the outer surface of the overmolding. This overmolding may also permit, starting with a standard core, production of various types of finish which multiplies the number of possible bows within a range without requiring extremely costly means of implementation.

As is self-evident, the invention is not limited only to the embodiments of this grip, described hereinabove by way of examples, but, on the contrary, embraces all alternative embodiments thereof.

We claim:

1. A bow grip whose extremities are each equipped with means for fixing a branch and whose central portion comprises a gripping zone for a hand, which comprises a core made from composite material constituted by a thermoplastic or thermosetting resin reinforced with fibers, and an overmolding which, covering the core over at least a portion of its surface, is produced from a resin whose curing or injection temperature does not exceed the glass transition temperature of the resin constituting the core.

2. The bow grip as claimed in claim 1, wherein the fibers constituting the core are essentially unidirectionally oriented and their amount lies between 30 and 75% of the volume of the core.

3. The bow grip as claimed in claim 1, wherein the fibers are homogeneously distributed in the cross-section of the core, some of them at least being continuous and extending over the entire length of the grip.

4. The bow grip as claimed in claim 1, wherein the fibers have a modulus greater than 50 GPa and a strength greater than 1500 MPa.

5. The bow grip as claimed claim 1, wherein all the fibers are of the same type.

6. The bow grip as claimed in claim 1, wherein the fibers are of several different types, such as carbon, aramid, glass, polyethylene.

7. The bow grip as claimed in claim 1, wherein the core comprises other elements, such as localized reinforcements made from a fabric or a mat, or fillers constituted by short fibers or hollow spheres.

8. The bow grip as claimed in claim 1, wherein the core contains:

an epoxy resin based on bisphenol A, a hardener based on anhydride, an accelerator of the heterocyclic type.

9. The bow grip as claimed in claim 1, wherein the overmolding made from resin contains fillers, such as spheres or short fibers as well as inserts serving for fixing the branches and the accessories.

10. The bow grip as claimed in claim 1, wherein the overmolding resin is constituted by polyurethane.

11. The bow grip as claimed in claim 1, wherein the overmolding is injection molded.

* * * * *